United States Patent [19]

Silberberg

[11] Patent Number: 4,724,989

[45] Date of Patent: Feb. 16, 1988

[54] SAILBOARD CARRYING APPARATUS

[76] Inventor: Peter W. Silberberg, 72 Ketewomoke Dr., Halesite, N.Y. 11743

[21] Appl. No.: 48,838

[22] Filed: May 12, 1987

[51] Int. Cl.[4] ..... B65D 85/00; A45F 3/02; A63C 15/05

[52] U.S. Cl. ..... 224/202; 224/917; 224/205; 224/250; 224/258; 294/147; 294/157; 294/170; 150/52 R; D3/36

[58] Field of Search ..... D3/36; 114/39.2, 343; 294/137, 146, 147, 149, 150, 152, 153, 154, 155, 156, 157, 158, 170; 280/814; 441/74; 150/52 R; 224/917, 150, 191, 201, 202, 205, 235, 236, 250, 255, 257, 258, 264

[56] References Cited

U.S. PATENT DOCUMENTS

| | | | |
|---|---|---|---|
| 117,623 | 4/1871 | Broad | 294/155 |
| 154,283 | 8/1874 | Roemer | 294/154 |
| 310,641 | 1/1885 | Beatty | 294/152 |
| 424,806 | 4/1890 | Morris | 294/154 |
| 954,840 | 4/1910 | Wiedemann | 294/141 |
| 3,339,607 | 9/1967 | Howard | 150/52 R |
| 3,377,007 | 4/1968 | Gayler, Jr. | 224/205 |
| 3,960,302 | 6/1976 | Mazzoni, Jr. | 294/147 |
| 4,002,277 | 1/1977 | Westerholm | 294/147 |
| 4,483,380 | 11/1984 | Beram | 150/52 R |
| 4,574,990 | 3/1986 | Remis | 224/255 |

FOREIGN PATENT DOCUMENTS

| | | | |
|---|---|---|---|
| 1470362 | 2/1967 | France | 294/149 |
| 2490597 | 3/1982 | France | 224/917 |

*Primary Examiner*—Henry J. Recla
*Assistant Examiner*—Ernest G. Cusick
*Attorney, Agent, or Firm*—Leonard Belkin

[57] ABSTRACT

A carrier for a sailboard comprising a carrier bar, spaced loops suspended from the bar to support the board, a second pair of loops suspended from the carrier bar to support the mast, on which the sail may be wrapped and a pouch supported from the bar to carry the daggerboard, and ropes. Mounted on the spaced loops for supporting the board are fasteners to secure the handle bar or boom.

9 Claims, 4 Drawing Figures

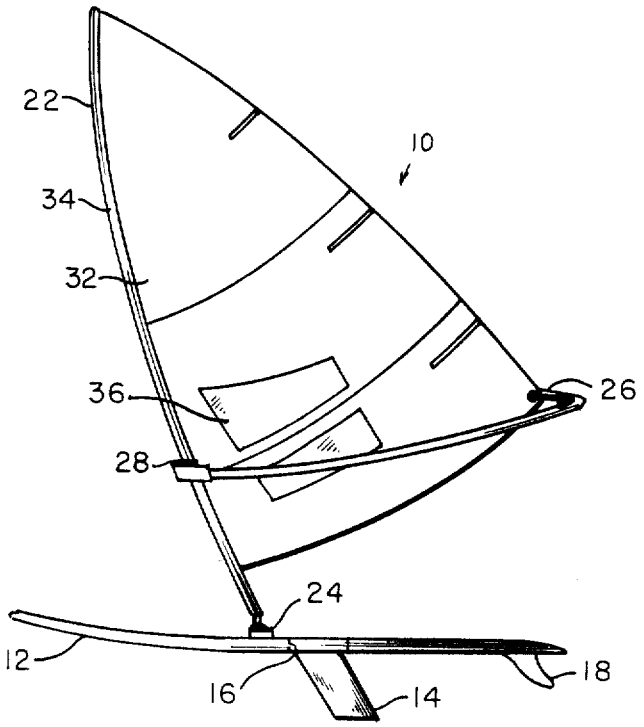
Fig. 1
Fig. 2
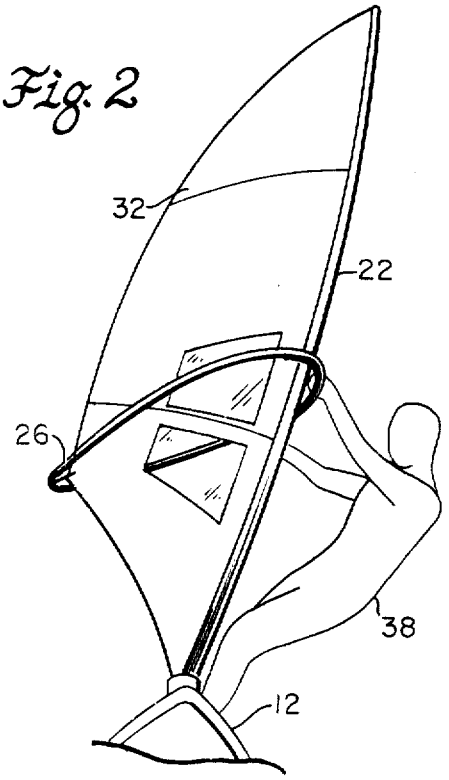
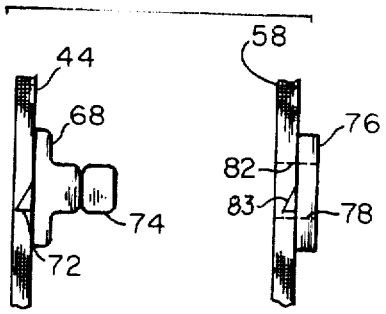
Fig. 4

SAILBOARD CARRYING APPARATUS

BACKGROUND OF THE INVENTION

This invention relates to a carryall for sports equipment and more particularly to a carryall for sailboards.

The sport of sailboarding, sometimes referred to as boardsailing, has increased in popularity in recent years and has become established as an international sport recognized by the Olympics. In addition, other international and regional competitions, such as the Mistral American and World Championships, the Open Class World Championships, and the Pro-Am World Cup competition attest to the growing interest in the sport.

The equipment which comprises the usual sailboard is quite bulky, consisting generally of the board itself with a fin or skeg, a daggerboard, mast, wishbone boom, a sail, and accessories, all of which must be carried to its launching site and assembled for use. The ordinary surfboard consists usually only of the board itself and does not ordinarily present a problem of mobility.

The number and shape of the parts making up the sailboard can interfere with its portability, especially when the sportsman or competitor must travel to the site of his activity carrying his or her equipment.

Existing carrying devices are not suitable for use with sailboards. For example, in U.S. Pat. Nos. 310,641 and 154,283 there are shown shawl straps that could possibly be used to hold a board, but they lack adequate provision for the other parts of the assembly making up the equipment. U.S. Pat. No. 954,840 shows a traveling bag with a shoulder strap, completely useless with sailboard equipment. U.S. Pat. No. 113,623 also discloses a shawl strap, but this arrangement could not properly secure the board itself. U.S. Pat. No. 424,806 describes a strap holder for parcels with a lock in the handle bar. It does not appear capable of use with a sailboard.

U.S. Pat. No. 3,339,607 teaches a surfboard cover with straps and sleeves for tying down on a rack such as might be found on a vehicle. It is neither designed for, nor is it capable for use as, a carrier for the sailboard, and, further, has no provision for the other parts making up the sailboard as described above. U.S. Pat. No. 4,002,277 is for a ski toting device. U.S. Pat. No. 4,483,380 illustrates a protective cover for sports equipment such as surfboards. Neither patent would be useful to carry the sailboard with all its components.

SUMMARY OF THE INVENTION

The present invention is for a carryall especially designed to secure with portability the sailboard with all of its customary components.

In accordance with a preferred embodiment of this invention, there is provided a carrier for a sailboard apparatus which comprises an extended board, a daggerboard, a mast, a boom, and a sail, the carrier comprising an extended carrier bar, a pair of spaced straps suspended from said bar for enclosing the board, a pouch suspended from the bar for receiving and retaining the daggerboard, and including a sailboard securing line, loops at opposite ends of the bar to receive and constrain the mast, and straps mounted on the outside of the spaced straps for supporting the boom, and separate spaced loops to support the extended carrier bar, thereby insuring safe and convenient portability of the sailboard apparatus.

The novel arrangement comprising this invention makes it possible to carry in a compact and convenient manner all of the usual components of the sailboard, at the same time accomplishing that result in an economic construction without sacrificing convenience, portability, and security of the apparatus.

It is therefore a principal object of this invention to provide a carrier for sailboards and the like having improved portability, convenience, and security.

Other objects and advantages of this invention will hereinafter become obvious from the following detailed description of preferred embodiments of this invention.

BRIEF DESCRIPTION OF THE DRAWINGS

FIG. 1 is a side elevation view of a typical sailboard rigged and ready for use.

FIG. 2 illustrates a sailboard in use.

FIG. 4 is an exploded side view of a fastener.

DETAILED DESCRIPTION OF THE PREFERRED EMBODIMENTS

Figure 3:
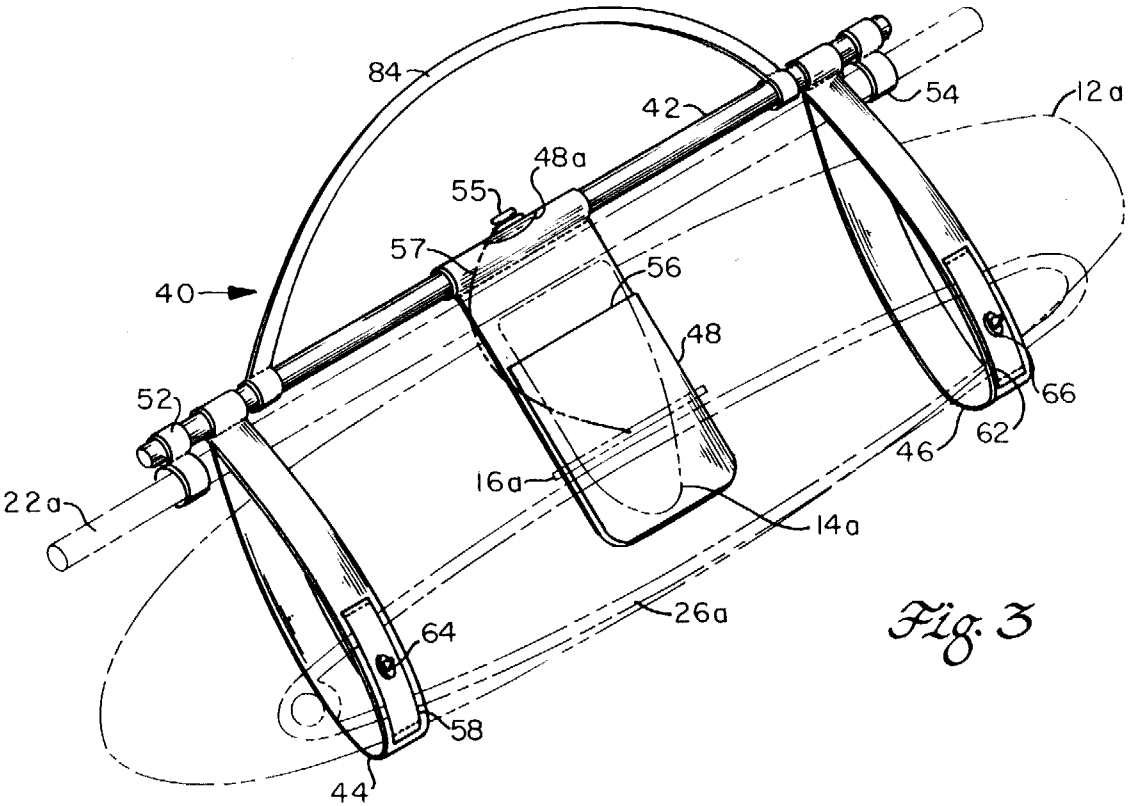
FIG. 3 is an isometric view of a preferred embodiment of this invention with the parts of the sailboard shown in phantom.

Referring to FIG. 1, sailboard 10 consists of the hull or board 12 and daggerboard 14 which passes through board 12 by way of a slot 16. Board 12 is provided with a fin or skeg 18 located at its tail or stern. Mast 22, with a slight arcuate configuration, is attached to board 12 by way of a mast foot 24 which includes a universal joint as is understood in the art, thus permitting mast 22 to be rotated and tilted by the individual riding sailboard 10. A wishbone shaped handle bar or boom 26 is attached at one extremity to mast 22 by way of a rolling hitch 28, while the other end of boom 26 provides the outhaul support for sail 32. The latter which typically has a triangular configuration, is attached to mast 22 by way of a sleeve 34.

Sail 32 is provided with one or more windows 36 made of transparent material so that the operator of sailboard 10 can see through sail 32. The remaining elements of the configuration, illustrated but not described, as well as that which has already been described, are conventional in sailboards.

It is understood, however, that many variations in sailboard construction do exist. For example, the shape of board 12 may vary, for some applications there may not be a daggerboard or even a skeg. In addition, the mast could be straight or curved, boom shapes may vary, and of course the aspect ratio of the sail may change.

As seen in FIG. 2, operator 38 stands on board 12 holding either or both of mast 22 and boom 26 against the wind, manipulating the rigging to obtain the speed and direction of movement desired.

The present invention, the preferred embodiment of which will now be described, will accomodate virtually all of the usual modifications of the basic sailboard construction which are in existence today.

Referring to FIG. 3, carrier 40 consists of a carrier bar 42 which need not be as long as board 12*a* (as seen in phantom), from which are suspended a pair of flexible, spaced board straps or loops 44 and 46, a daggerboard pouch 48 of flexible material, suspended from a central portion of bar 42, and a pair of mast straps or loops 52 and 54 of flexible material to accommodate mast 22*a* as illustrated in phantom. A cleat 55 is mounted on carrier bar 42 through an opening 48*a* in pouch 48 for a purpose to be later described. It will be noted that the spacing of loops 52 and 54 at the extremities of bar 42, to the outside of loops 44 and 46 results in the accommodation of any of the usual shapes of masts, that is, from straight masts as shown in FIG. 3, to curved masts as shown in FIG. 1.

Pouch 48 includes a pocket 56 to accommodate daggerboard 14a in the manner illustrated, and may be sized to accomodate the sail and the various ropes and lines illustrated in FIG. 1 but not described, but which are a part of the accessories included in all sailboards. However, typically the sail would be wrapped around mast 22a.

A sailboard securing line or rope means 57 attached at one end to the underside of pouch 48 would pass through slot 16a in sailboard 12a and be attached to cleat 55 as added insurance against movement of board 12a. It should be noted that some sailboards do not employ daggerboards and therefore such a board would not have a slot.

A pair of straps 58 and 62 mounted on the outside of loops 44 and 46, respectively, support the ends of boom 26a. An important feature of this invention is the presence of a pair of turn fasteners 64 and 66 located on straps 58 and 62 to permit attaching of straps 58 and 62 to loops 44 and 46, respectively to secure boom or handle bar 26a from sliding out. Fasteners 64 and 66 are conventional, each consisting (as seen for fastener 64 in FIG. 4) of a male member 68 mounted on the outside of loop 44 with teeth 72 penetrating the former to hold male member 68 in place. An elongated, rotatable member 74, which is a part of male member 68, is designed to enter female member 76 through an elongated slot 78 in member 76 and a matching slot 82 in strap 58 and rotated 90 degrees. Teeth 83 secure member 76 in place. Fastener 66 on strap 62 is identical to fastener 64.

In the use of straps 58 and 62 to secure boom or handle bar 26a, fasteners 64 and 66 pass through the opening in the former so that once the rotatable member (74 in fastener 64) penetrates female member 76 and rotated 90 degrees it can not pass through slots 78 and 82, and fastener 66 is similarly engaged, handle bar 26a is securely held in place. In addition, due to the flexibility of straps 44 and 46, the latter can be adjusted to accommodate both board 12a and bar 26a, of any of the usual sizes and shapes, and the presence of fasteners 64 and 66 coupled to bar 26a will prevent their separation and so will at the same time secure board 12a as well. In other words, handle bar or boom 26a becomes part of the carrier apparatus in that it insures that straps 44 and 46 will not separate and release board 12a.

A shoulder strap 84 attached to bar 42 as illustrated may be utilized as a convenient way of permitting carrier 40 to be held.

All of the straps and/or loops illustrated may be constructed of suitable flexible material such as leather, imitation leather or plastic, or fabric. Buckles or other conventional means may be employed to adjust the length of each of the loops or straps, so that they are all ajustable as to length. In addition, loops 44 and 46, loops 52 and 54, and pouch 48 may be made adjustable along the length of carrier bar 42.

It will be seen that the arrangement described is sufficiently flexible in configuration that it will adapt well to any of the usual sailboard configurations. It will accomodate the components of the sailboard in a compact and efficient manner, while at the same time holding the parts securely and in a manner which is highly portable and convenient.

While only a preferred embodiment of this invention has been described, it is understood that many variations are possible without departing from the principles of this invention as defined in the claims which follow.

What is claimed is:

1. A carryall for sailboard apparatus, having sailboard apparatus comprising an extended board, a mast, a boom, and a sail, said carryall comprising an extended carrier bar having ends, a pair of spaced straps suspended from said bar for enclosing said board, loop means adjacent opposite ends of said bar to receive and constrain said mast, said pair of spaced straps and said loop means being adjacent each other means mounted on the outside of said spaced straps for supporting and restraining said boom, and means to support said extended carrier bar, thereby insuring safe and convenient portability of said sailboard apparatus.

2. The carryall of claim 1 in which said means mounted on said spaced straps includes means to limit the separation of said loops thereby securing said board in said carryall.

3. The carryall of claim 2 in which said spaced straps are made of flexible material to accomodate boards of different sizes.

4. The carryall of claim 3 in which each of said loop means is located on said carrier bar between its adjacent strap and the end of said carrier bar.

5. The carryall of claim 4 in which all of said straps and loops are adjustable along the length of said carrier bar.

6. The carryall of claim 2 in which the means mounted on said straps to limit the separation of said straps includes fastener means on each of said straps to pass through said boom to lock said boom in place, said boom thereby functioning as a part of said carrier to prevent separation of said straps and release of said board.

7. The carryall of claim 1 in which said sailboard apparatus additionally includes a daggerboard, said carryall including pouch means suspended from said bar for receiving and retaining said daggerboard.

8. The carryall of claim 7 having interconnecting means interconnecting said pouch means and said carrier bar for restraining said board.

9. The carryall of claim 8 in which said board has a slot to accomodate said daggerboard, said interconnecting means including a cleat mounted on said carrier bar and rope means having ends attached at one end to said pouch means passing through said slot for attachment to said cleat.

* * * * *

UNITED STATES PATENT AND TRADEMARK OFFICE

CERTIFICATE OF CORRECTION

PATENT NO. : 4,724,989

DATED : February 16, 1988

INVENTOR(S) : Peter W. Silberling

It is certified that error appears in the above-identified patent and that said Letters Patent is hereby corrected as shown below:

On the title page, item [19] the inventor's last name should read

--Silberling-- item [76] the inventor's last name should read

--Silberling--.

Signed and Sealed this

Twenty-eighth Day of June, 1988

*Attest:*

DONALD J. QUIGG

*Attesting Officer*

*Commissioner of Patents and Trademarks*